United States Patent [19]

Boman

[11] Patent Number: 4,660,328

[45] Date of Patent: Apr. 28, 1987

[54] ROTATABLE HOLDER FOR PLURAL GRINDING SPINDLES

[75] Inventor: Pertti J. Boman, Säter, Sweden

[73] Assignee: AB UVA, Bromma, Sweden

[21] Appl. No.: 753,498

[22] Filed: Jul. 10, 1985

[51] Int. Cl.[4] ..... B24B 41/00

[52] U.S. Cl. ..... 51/166 T; 51/166 TS

[58] Field of Search ..... 51/166 T, 166 TS, 166 R, 51/166 MH, 35

[56] References Cited

U.S. PATENT DOCUMENTS

| | | | |
|---|---|---|---|
| 925,867 | 6/1909 | Bryant | 51/166 T |
| 3,137,104 | 8/1962 | Banko | 51/166 R |
| 3,686,796 | 8/1972 | Clark | 51/166 TS X |
| 3,721,045 | 3/1973 | Wojcik | 51/35 |
| 4,136,489 | 1/1979 | von Allmen | 51/166 T X |

FOREIGN PATENT DOCUMENTS

| | | |
|---|---|---|
| 611327 | 9/1926 | France . |

*Primary Examiner*—Frederick R. Schmidt
*Assistant Examiner*—Maurina Rachuba
*Attorney, Agent, or Firm*—Sughrue, Mion, Zinn, Macpeak and Seas

[57] ABSTRACT

A grinding spindle holder accommodates two or more grinding spindles and is mounted on, or adapted to be fitted to a feed slide of a grinding machine. The spindle holder has a stationary base part and a movable part which accommodates the grinding spindles and which can be rotatably stepped between given terminal positions by swinging the movable holder part about a shaft extending parallel with the spindle axes, for consecutive movement of the spindles to a grinding position for engagement with a workpiece in one and the same chuck position. The movable holder part can be swung by means of a working piston-cylinder device between two stop abutments located on the base part of the holder, of which stop abutments at least one can be adjusted in a manner to accurately determine the position of a relevant grinding spindle in the grinding position. The spindle holder is also provided with means for damping the swinging movement of the movable holder part towards respective stop abutments.

5 Claims, 4 Drawing Figures

ROTATABLE HOLDER FOR PLURAL GRINDING SPINDLES

BACKGROUND OF THE INVENTION

The present invention relates to grinding spindle holders adapted to accommodate two or more grinding spindles, and mounted on, or adapted for attachment to a feed slide guided for movement on a working table of a grinding machine, said holder having a stationary base part mounted on the slide, or adapted for attachment thereto and a moveable spindle-receiving part which can be stepped rotationally about an axis parallel with the spindle axes, to move the spindles consecutively into a grinding position for engagement with a workpiece in one and the same chuck position.

Various kinds of multi-spindle, rotatable holders of the kind driven by a common drive means in the form of a belt transmission which drives the relevant spindle located in a working position are known to the art, for example from U.S. Pat. Nos. 925,867; 1,051,483; and 2,300,481; and from the French Patent Specification No. 611 327, all of which describe and illustrate older types of arrangement.

These known older spindle arrangements, however, are unable to fulfil the accuracy requirements of today, among other things because the spindles cannot be adjusted in their working positions which sufficient precision.

In more recent grinding machines, each spindle is normally driven individually by a separate drive motor, which renders the use of the arrangement to produce the stepped rotary movement achieved by the older arrangements described in the aforesaid patent specifications impossible.

SUMMARY OF THE INVENTION

Accordingly, one object of the present invention is to provide a grinding spindle holder of the kind described in the introductory paragraph with which the aforesaid disadvantages are avoided.

Another object is to provide a grinding spindle holder with which grinding can be effected with improved efficiency and at low grinding costs.

A further object is to provide a grinding spindle holder which will fulfill high precision requirements made with regard to the measurement of a workpiece, its geometry and surface fineness more effectively than has hitherto been possible with known rotatable stepping grinding machines.

These and other objects are fulfilled by means of a grinding spindle holder according to the invention, which is mainly characterized in that the movable part of the spindle holder can be swung with the aid of suitable drive means, for example an hydraulic or pneumatic working piston-cylinder device, between two stop means located on the base part, of which stop means at least one can be adjusted in a manner to accurately define the position of a relevant spindle in a working position.

In its one terminal position a spindle according to the invention can be positioned relative to the feed slide and the chuck dolly with an extremely high degree of accuracy, which means that positioning of the spindle in its other terminal position, i.e. subsequent to swinging the movable part of the spindle holder in the vertical plane, can also be effected with a high degree of accuracy, since the first-mentioned terminal position can be used as a point of reference.

Another important advantage afforded by the invention is that the spindle holder can be given the form of a module assembly capable of being used with various types of grinding machines, for example as a standard component in existing grinding machines, thereby enabling the machines to be updated and made more adaptable to modern production requirements.

The accuracy in which work is performed is further increased and the absence of play further ensured when, in accordance with one preferred embodiment, the spindle holder is provided with means for damping the oscillatory movement towards respective stop means.

The working piston-cylinder device is preferably pivotally mounted on lugs on the pivotal holder part, while the piston rod of said device is passed through a slot or like aperture therein, to engage the base part of the holder.

One embodiment of the spindle holder is characterized by means for detachably locking the movable holder part in at leastone stepped position in which said part is liable to swing back under gravity, should the supply of working fluid to the piston-cylinder device be interrupted.

A spindle holder constructed according to the invention and having the form of a module assembly may be used, for example, for grinding different transmission and injection components for use in the automotive vehicle industry, and for grinding valves for hydraulic systems and various elements and details within the current workshop industry. In this respect the spindle holder forms an extremely stable, play-free machine component which can even be readily incorporated in systems characterized by the highest possible degree of automatization.

The movable spindle holder part is preferably journalled on heavily pre-stressed conical roller bearings.

The stepped rotational positions of the spindles may be controlled by a non-contacting position indicator monitored by an automatic control system, suitably a data-based control system.

BRIEF DESCRIPTION OF THE DRAWINGS

An exemplary embodiment of the invention will now be described in more detail with reference to the accompanying drawings, in which.

DETAILED DESCRIPTION OF THE PREFERRED EMBODIMENT

Figure 1:
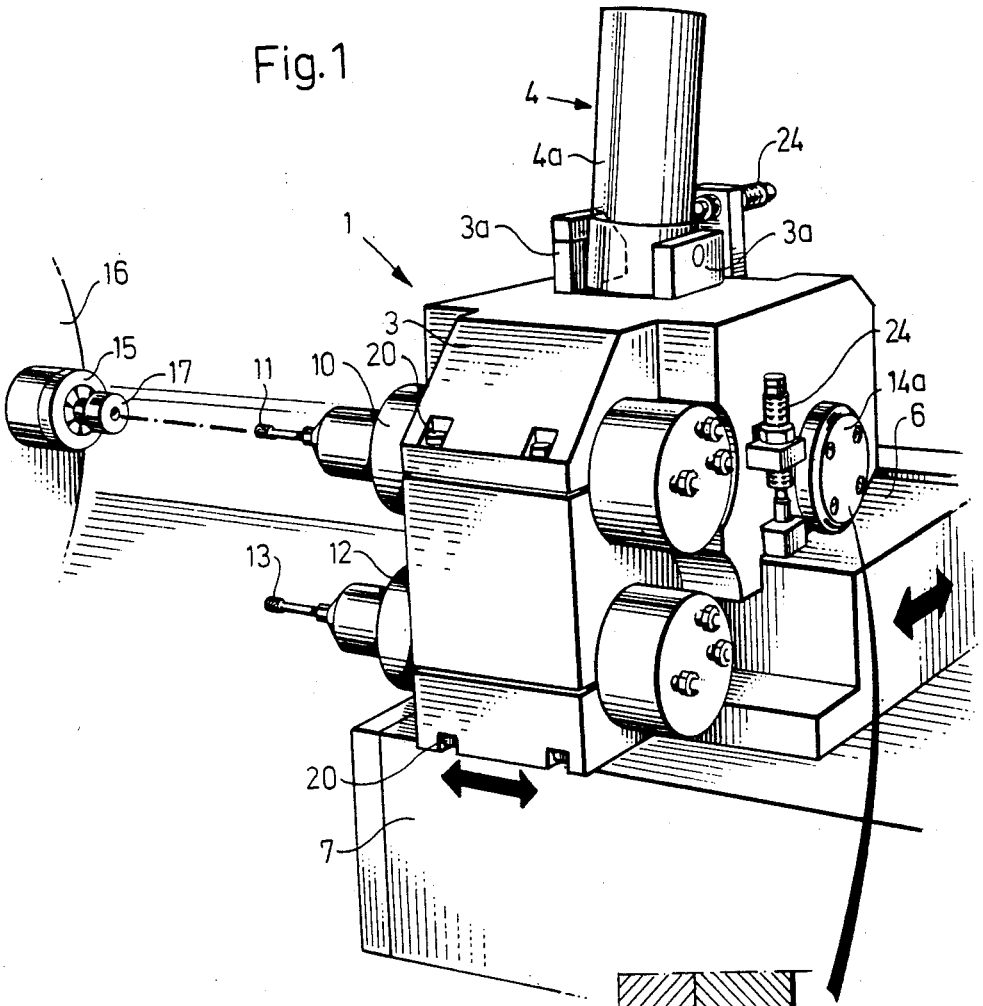
FIG. 1 is an illustration in perspective of a grinding spindle holder constructed in accordance with the invention and carried on the feed slide of a grinding machine, the illustrated holder accommodating two spindles having mounted thereon two grinding discs of distinctly different characters, for engagement with a workpiece in one and the same position.

Illustrated in the drawings and identified generally by the reference 1 is a grinding spindle holder arranged for rotational stepping movement and having the form of a module assembly. The holder is shown mounted on a feed-slide or cross-slide guided for movement on a working table 7 on the bed of the grinding machine. The spindle holder comprises a stationary base part 2 mounted on the feed slide 6, and a movable part 3 which can be swung in the vertical plane between two distinct stepped positions with the aid of an hydraulic or a pneumatic working device 4 comprising a cylinder 4*a* and an associated piston rod 4*b*. The cylinder 4*a* is journalled on lugs 3*a* located on the movable holder part 3, and the piston rod 4*b* is passed through a slot or like aperture in the movable holder part and connected to the base part 2.

Figure 2:
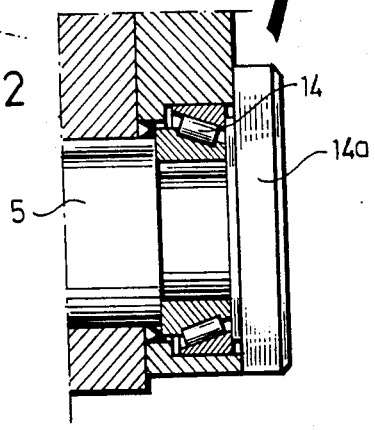
FIG. 2 is a cross-sectional view illustrating part of the stepping shaft and its pre-tensioned conical roller bearing.
Figure 3:
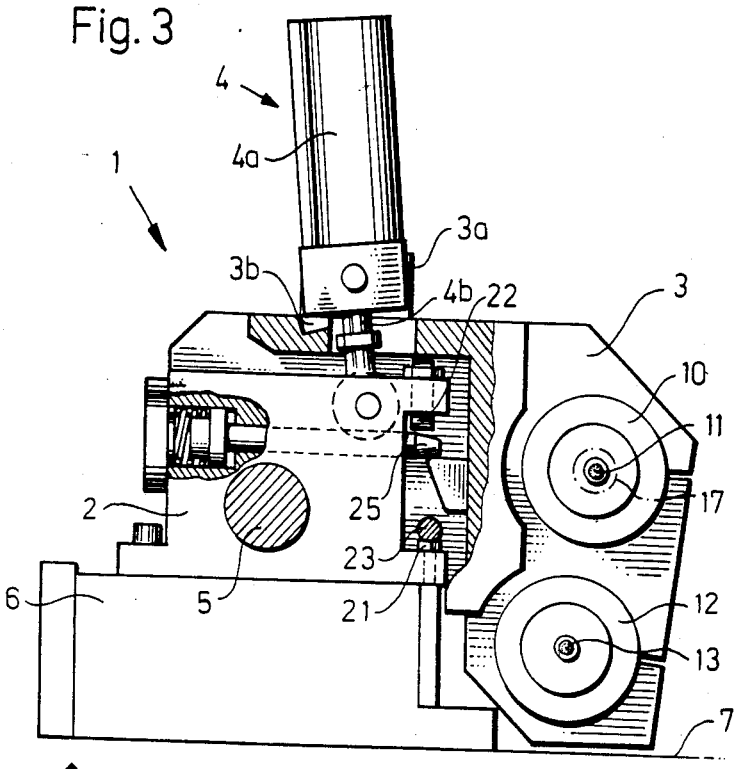
FIG. 3 is a partially cut-away front view of the spindle holder in its first stepped position.
Figure 4:
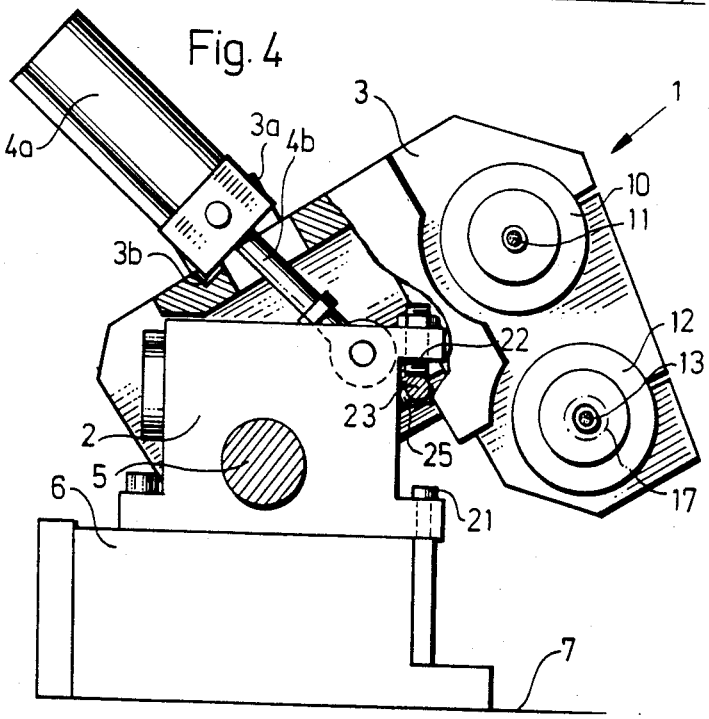
FIG. 4 shows the spindle holder of FIG. 3 with the movable holder part upwardly swung in the vertical plane to the second stepped position.

The swinging movement is effected about a stepping shaft 5 which presents at both ends thereof highly prestressed conical roller bearings 14, one of which is illustrated in FIG. 2.

The movable holder part 3 accommodates detachably two grinding spindles 10 and 12, each of which presents a respective grinding disc 11 and 13 of significantly different properties. For example, the grinding disc 11 may comprise Borazon or the like, a highly efficient grinding material, while the grinding disc 13 is intended to produce a super finish, and may comprise a ceramic material having a particle size beneath 400 mesh for example.

Thus, the grinding disc 11 performs the heavy grinding work while achieving a high degree of geometric accuracy, while the fine grinding disc 13 is used to achieve a super finish. The grinding discs are intended to work a workpiece 17, which in the illustrated embodiment is assumed to be an injection nozzle for the engine of a motor vehicle, this workpiece being mounted in a chuck 15 on a stepping chuck-spindle dolly 16.

The grinding spindles 10, 12 are stepped by swinging the movable holder part in the vertical plane about the horizontal shaft 5, and the workpiece 17 is consecutively ground by means of the grinding discs 11 and 13 in one and the same chuck position.

The movable grinding spindle holder 3 can accommodate different types of grinding spindles 10. It is possible to use pneumatic, high-speed spindles instead of the electrical, high-frequency spindles illustrated. Spindles driven by conventional motors may also be used. It will be seen from FIG. 1 that the grinding spindles 10 and 12 can be readily exchanged subsequent to loosening the screws 20.

The two positions to which the spindles are stepped are defined by hardmetal coated stop abutments 21,22 located at each end of the base part 2, these stop abutments coacting with a peg or stud 23 mounted on the movable holder part 3. The one stop abutment 21 is fixed, while the other, 22, can be adjusted to permit fine adjustment of corresponding stepped positions.

A rapid and distinct movement between the two stepping positions can be effected by the working piston-cylinder device 4, when a separate damping means 24 is arranged in connection with the stop abutments 21 and 22.

In order to assure a satisfactory absence of play in the two stepping positions, separate locking plungers 25 are used to fix the position of the movable holder part. This has a particular significance in the outwardly swung stepping position, since if the working fluid to the cylinder 4*a* should be interrupted for some reason or other, the movable spindle holder part 3 is liable to return inadvertently to the lower position under the force of gravity, therewith causing damage to vital components of the arrangement.

Normally it is also desirable, however, to lock the movable spindle holder in the lower stepping position, in order to ensure a satisfactory absence of play.

The two grinding discs suitably co-operate with an automatic sharpening control means, which may be of a conventional kind and will not therefore be described in detail.

The stepping positions may be controlled with the aid of non-contacting position indicators (not shown) monitored by a suitable control system.

In addition to the aforementioned advantages, an arrangement of the kind described enables a greater degree of freedom in the selection of work cycle periods. By effecting the aforesaid rough grinding process with a grinding disc 11 made of Borazon, for example, it is possible to greatly shorten the total grinding time in relation to methods used hitherto, where a compromise must be made in the choice of grinding disc used.

It will readily be perceived that when thousands of similar workpieces need to be ground, the work cycle time is highly significant to grinding economy. The use of a grinding spindle holder of the aforesaid kind also enables high quality requirements to be achieved more effectively than was previously possible. This is true irrespective of the grinding process to which the workpiece is to be subjected, since practical tests have shown that it is possible to achieve a substantial increase in grinding accuracy when grinding both seatings, holes and when surface grinding.

It will be seen that a movable spindle holder constructed within the scope of the invention can accommodate more than two grinding spindles, in which case at least two of said spindles will suitably carry grinding discs of significantly different properties. Different grinding tools can therewith work different surfaces on the workpiece.

The trade name "Borazon" used in the aforegoing signifies the material boron nitride, both in the present description and in the claims.

I claim:

1. A mounting and positioning arrangement for two grinding spindles, comprising:

(a) a grinding machine bed including a work table (7), (b) a feed slide (6) mounted on the work table for longitudinal and transverse movement relative thereto, (c) a base member (2) fixedly mounted to and movable with the feed slide, (d) a holder member (3) mounted to the base member for stepped rotation about a pivot shaft (5) disposed parallel to a direction of longitudinal movement of the feed slide, said holder member being configured as a U-shaped yoke having opposite legs flanking the base member, and said legs being individually journalled to opposite ends of the pivot shaft by prestressed conical bearings (14), (e) two grinding spindles (10, 12) mounted on the holder member, spaced from each other, equidistant from the pivot shaft, and having axes of rotation parallel to each other and to the pivot shaft, (f) two drive motors individually coupled to the spindles for rotatably driving them, (g) a fluid piston and cylinder unit (4) operatively coupled between the base member and the holder member for rotatably stepping the holder member to place a selected one of the spindles in a grinding position relative to a workpiece (17) held at a predetermined chuck position, (h) two stop members (21, 22) individually mounted on the base member and engageable with the holder member for defining respective raised and lowered rotational limit positions of the holder member, an upper one of said stop members being adjustable, and (i) locking means (25) separate and distinct from the stop members for releasably locking the holder member in said raised position to prevent the fall thereof under the influence of gravity upon an interruption of fluid pressure to the piston and cylinder unit.

2. An arrangement according to claim 1, further comprising means (24) for damping oscillatory movements of the holder member during its travel towards a respective stop means.

3. An arrangement according to claim 1, wherein a cylinder (4*a*) of the piston and cylinder unit is pivotally mounted on lugs (3*a*) on the holder member, and a piston rod (4*b*) of said unit extends through an aperture in said holder member into engagement with the base member.

4. An arrangement according to claim 2, wherein a cylinder (4*a*) of the piston and cylinder unit is pivotally mounted on lugs (3*a*) on the holder member, and a piston rod (4*b*) of said unit extends through an aperture in said holder member into engagement with the base member.

5. An arrangement according to claim 1, wherein the spindles and associated drive motors are removably (20) clamped in the holder member.

* * * * *